US005566835A

United States Patent [19]

Grimes

[11] Patent Number: 5,566,835

[45] Date of Patent: Oct. 22, 1996

[54] CLEANER WITH INVERTED HYDROCYCLONE

[75] Inventor: David B. Grimes, Greenfield, Mass.

[73] Assignee: Beloit Technologies, Inc., Wilmington, Del.

[21] Appl. No.: 539,445

[22] Filed: Oct. 5, 1995

[51] Int. Cl.[6] ..... B03B 5/34

[52] U.S. Cl. ..... 209/725; 209/731; 209/733; 210/512.1

[58] Field of Search ..... 209/731, 733, 209/725; 210/512.1, 512.2, 512.3

[56] References Cited

U.S. PATENT DOCUMENTS

| | | | |
|---|---|---|---|
| 2,769,546 | 11/1956 | Fontein | 209/725 X |
| 2,787,374 | 4/1959 | Krebs . | |
| 2,809,567 | 10/1957 | Woodruff . | |
| 3,405,803 | 10/1968 | Bahr et al. . | |
| 4,226,707 | 10/1980 | Boivin | 209/731 |
| 4,259,180 | 3/1981 | Surakka et al. . | |
| 4,309,283 | 1/1982 | Vikio et al. . | |
| 4,378,289 | 3/1983 | Hunter . | |
| 4,414,112 | 11/1983 | Simpson et al. | 209/725 X |
| 4,578,199 | 3/1986 | Peel et al. . | |
| 4,786,412 | 11/1988 | Lister et al. . | |
| 4,797,203 | 1/1989 | Macierwicz . | |
| 4,842,145 | 6/1989 | Boadway . | |
| 4,919,796 | 4/1990 | Vikio . | |
| 5,024,755 | 6/1991 | Livsey . | |
| 5,266,198 | 11/1993 | Vikio . | |
| 5,470,465 | 11/1995 | Moorehead et al. | 209/731 X |

OTHER PUBLICATIONS

"Beloit Jones Posiflow Cleaners", Beloit Jones Division, Beloit Corporation–Brochure (No Date).

"Beloit Corporation Uniflow Cleaners", Beloit Jones Division Beloit Corporation–brochure (No Date).

*Primary Examiner*—D. Glenn Dayoan

*Attorney, Agent, or Firm*—Dirk J. Veneman; Raymond W. Campbell

[57] ABSTRACT

A cleaner receives input pulp stock in an inverted conical chamber, which acts as a hydrocyclone to direct heavyweight reject flows outwardly, lightweight reject flows into a discharging vortex chamber and accept flows in between to a vortex finder for removal. The cleaner body has an inverted hydrocyclone chamber formed beneath the inverted cone and a ceramic splitter below which skims off the heavyweight reject flow from the accept flow, and diverts it into the inverted hydrocyclone chamber. A portion of the diverted heavyweight reject flow is removed through a toroidal heavyweight rejects relief outlet, but the larger fraction of the heavyweight reject flow is recirculated within the inverted hydrocyclone chamber. Because the chamber narrows as it extends upwardly, the flow increases in speed and angular velocity to such an extent that the flow within the inverted hydrocyclone chamber matches the flow passing by the chamber, thereby preventing turbulent mixing.

21 Claims, 3 Drawing Sheets

CLEANER WITH INVERTED HYDROCYCLONE

FIELD OF THE INVENTION

The present invention relates to particle separators in general, and to hydrocyclone cleaners for papermaking pulp stock in particular.

BACKGROUND OF THE INVENTION

Paper is typically manufactured from cellulose fibers which are extracted from a number of sources, principally wood and recycled paper. The various sources and processes for creating and separating the individual wood fibers results in a paper stock containing contaminants which must be removed before the wood fibers can be used to make paper. While many contaminants can be removed from the fiber stock by screening, other contaminants are of a size which makes their removal by filtration difficult. Historically, hydrocyclones or centrifugal cleaners of relatively small size, normally from 2–72 inches in diameter have been employed. It has been found that the centrifugal type cleaner is particularly effective at removing small area debris such as broken fibers, cubical and spherical particles, and seeds, as well as non-woody fine dirt such as bark, sand, grinderstone grit and metal particles.

The relatively small size of the centrifugal cleaners allows the employment of certain hydrodynamic and fluid dynamic forces provided by the combination of centrifugal forces and liquid shear planes produced within the hydrocyclone which allows the effective separation of small debris.

The advent of certain modern sources of pulp fibers such as tropical wood species and recycled paper which is contaminated with stickies, waxes, hot melt glues, polystyrenes, polyethylenes, and other low density materials including plastics and shives presents additional problems in the area of stock preparation. The ability of the hydrocyclone to separate both high density and low density contaminants gives them particular advantages in dealing with the problem of cleaning modern sources of paper fiber. Many modern fiber sources tend to be contaminated with both heavyweight and lightweight contaminants.

In one common type of forward cleaner, the flow of acceptable material must change direction at the bottom of the cleaner and travel back up to the top. Such a cleaner also has little control on changing the reject flow volume. To limit the amount of good fiber lost, it is necessary to restrict the volume of material rejected. This usually requires that the rejects orifice be small and in the center of the cleaner. Various systems using elutriation water have also been tried, but it is fed from the outside diameter of the rejects area. Rejects volume in these cases would be controlled by elutriation water pressure and rejects flow control valves which are expensive on small cleaners and need to be carefully monitored.

While existing hydrocyclones have been developed to remove both heavy and light contaminants, further improvements in this area are highly desirable. The fact that each hydrocyclone is a small device, and they are therefore used in banks of up to sixty or more cleaners, means that each hydrocyclone must be of extremely high reliability and require minimal maintenance or the entire hydrocyclone system will have poor reliability and high maintenance costs. One particular problem with hydrocyclones which can aggravate the reliability and maintenance problems is that separation effectiveness increases as the size or rate of the reject flow increases. However, increasing the reject flow increases the rejection of good fiber. The rejection of good fiber, in turn, requires additional stages for the recovery and separation of the rejected good fiber. Decreasing the size of the rejection flow to decrease the rejection of good fiber typically leads to two problems: Loss of separation effectiveness and clogging of the hydrocyclone with sand and grit. Furthermore, because the heavyweight rejects flow is typically small compared to the total throughput of the cleaner, prior art cleaners present the possibility of very slow heavyweight reject flows which are more likely to clog the cleaner.

What is needed is a stock cleaner of increased effectiveness, while retaining acceptable reliability and fiber utilization.

SUMMARY OF THE INVENTION

The stock cleaner of this invention receives input stock into an inverted conical chamber, which acts as a hydrocyclone to displace higher density components of the stock to the outer walls of the chamber, while lightweight components remain in the center of the chamber, with acceptable fiber in the in-between region. The cleaner body has an inverted hydrocyclone chamber formed beneath the inverted cone and a ceramic splitter positioned beneath the inverted hydrocyclone chamber. A tubular vortex finder extends upwardly and receives lightweight rejects for channeling out of the cleaner. The splitter skims off the heavyweight reject flow from the accept flow, and diverts the heavyweight reject flow into the inverted hydrocyclone chamber. A portion of the diverted heavyweight reject flow is removed through a toroidal heavyweight rejects relief outlet, but the larger fraction of the heavyweight reject flow is recirculated within the inverted hydrocyclone chamber. Because the chamber narrows as it extends upwardly, the flow increases in speed and angular velocity to such an extent that the flow within the inverted hydrocyclone chamber matches the flow passing by the chamber, thereby preventing turbulent mixing.

The geometry of the cleaner avoids narrow passages through which heavyweight reject flow must pass, and maintains sufficient flow velocity that the opportunity for clogging or blockage is greatly reduced.

It is a feature of the present invention to provide a stock cleaner which extracts heavyweight and lightweight contaminants from a flow of acceptable fibers without causing the separated flows to cross.

It is another object of the present invention to provide a cleaner with improved efficiency.

It is a further feature of the present invention to provide a cleaner which has stable performance for varying input flows.

It is an additional feature of the present invention to provide a cleaner which is resistant to clogging and plugging.

It is also a feature of the present invention to provide a cleaner which is resistant to wear and which has no moving parts.

Further objects, features and advantages of the invention will be apparent from the following detailed description when taken in conjunction with the accompanying drawings.

DESCRIPTION OF THE PREFERRED EMBODIMENT

Figure 1:
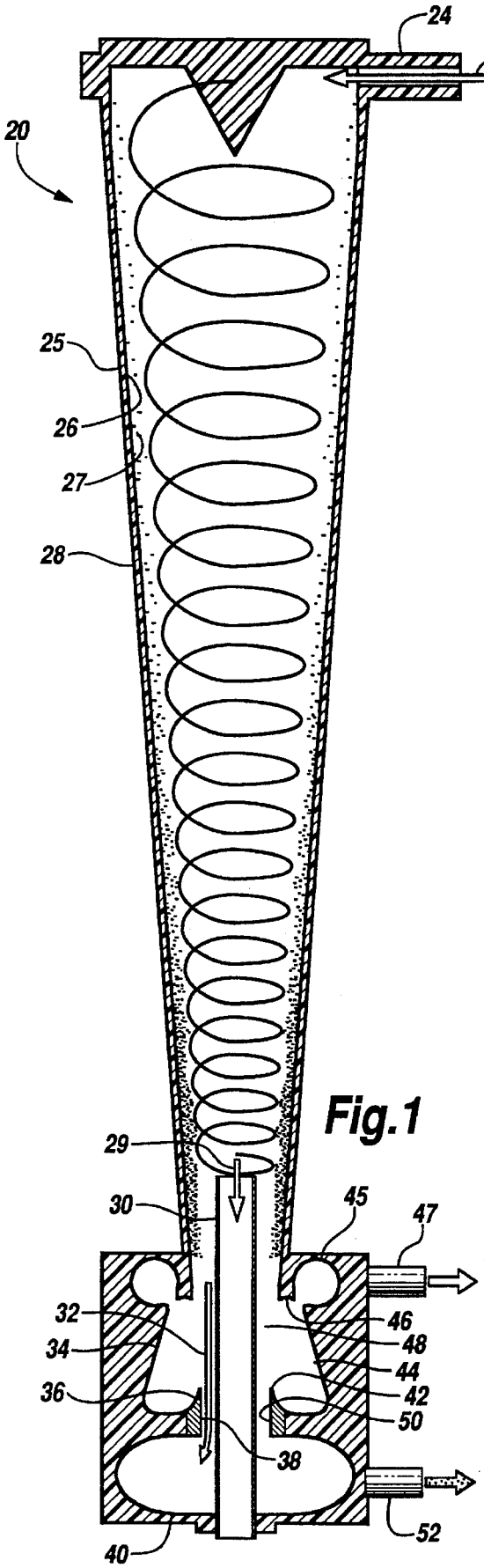
FIG. 1 is a cross-sectional view of the cleaner of this invention.

Referring more particularly to FIGS. 1–5 wherein like numbers refer to similar parts, a cleaner 20 of this invention is shown in FIG. 1. The cleaner 20 will typically find application in a bank of four to sixty or more cleaners which are supplied with input stock 22 through a common header. In papermaking, uniformity of paper pulp is essential to maintaining desired consistency of operation and reliable qualities in the paper produced. It is therefore important that the wood fibers be of the desired size and be separated from contaminants which would hamper optimum performance.

The cleaner 20 in a pulp cleaning application is one part of a system which treats the pulp prior to introduction to the papermaking machine. For example, the stock will first be treated in a pulper, and will be processed through high density cleaners which remove rocks, nuts and bolts, and other high density objects. Next the stock proceeds through a course screen which removes objects larger than 0.050 inches. Thus the stock which reaches the cleaner 20 will have had large and very dense particles removed. However, the input stock 22 may still be contaminated with small size particles. The contaminants of concern will vary depending on the source of the pulp. For example, in old corrugated cardboard (OCC) applications, where used corrugated material is repulped, lightweight contaminants are plastics, waxes and stickies, while the heavyweight contaminants may include sand, glass, and grit. Although both types of contaminants adversely affect paper quality, the heavyweight contaminants may also be destructive to downstream pulp treating apparatus, causing accelerated wear by abrasion.

The input stock 22 is fed tangentially through an infeed tube 24 into an inverted conical chamber 26 formed within the cleaner body 25. The body 25 is preferably formed of ZYTELu material, which is a glass filled nylon resin manufactured by E. I. Du Pont de Nemours Company, of Wilmington, Del. Alternatively the body could be polyurethane, which has desirable abrasion resistance. The body 25, although shown as a single part, will preferably be formed as upper and lower sections, and connected by a quick release clamp with an O-ring seal.

The tangential input of the stock 22 causes the stock to spin rapidly within the chamber, and also to travel downwardly within the chamber 26, as shown in FIG. 1. As a result of this spinning, higher density particles 27 will migrate to the walls 28 of the chamber 26, low density particles 29 will tend to remain along the vertical axis of the chamber 26, and particles of acceptable density will tend to remain between those two extremes. The large density particles 27 are illustrated schematically in the figures. It should be noted that the size and concentrations of the particles shown are not to scale. The difference in pressures between the inlet at the infeed tube 24 and the outlets from the cleaner 20 will effect the separating efficiency, and may be adjusted for various input stock characteristics by valves in the supply header and the accept and reject take-away headers, not shown.

Although moving at high rotational speeds (as much as 4,000 rpm), the stock should not experience turbulent flow within the chamber 26, and the flow is generally characterized as quasi-laminar. A key feature of this flow regime is that the particle fractions of different density, once separated, remain in distinct regions and do not recombine. The cleaner 20 is thus constructed to avoid creation of turbulent regions which would short-circuit the quasi-laminar flow and permit mixing between the separated fractions.

The cleaner 20 is particularly advantageous in that it is capable of removing both low density and high density reject fractions in a single pass. The low density rejects 29 are removed from the flow by means of a narrow diameter cylindrical tube or vortex finder 30 which extends axially upwardly into the conical chamber 26 and extends downwardly out of the cleaner 20 to a light reject take-away header. The exterior diameter of the tube 30 is about 9/16 inches, and the inside diameter is about 0.413 inches.

Figure 3:
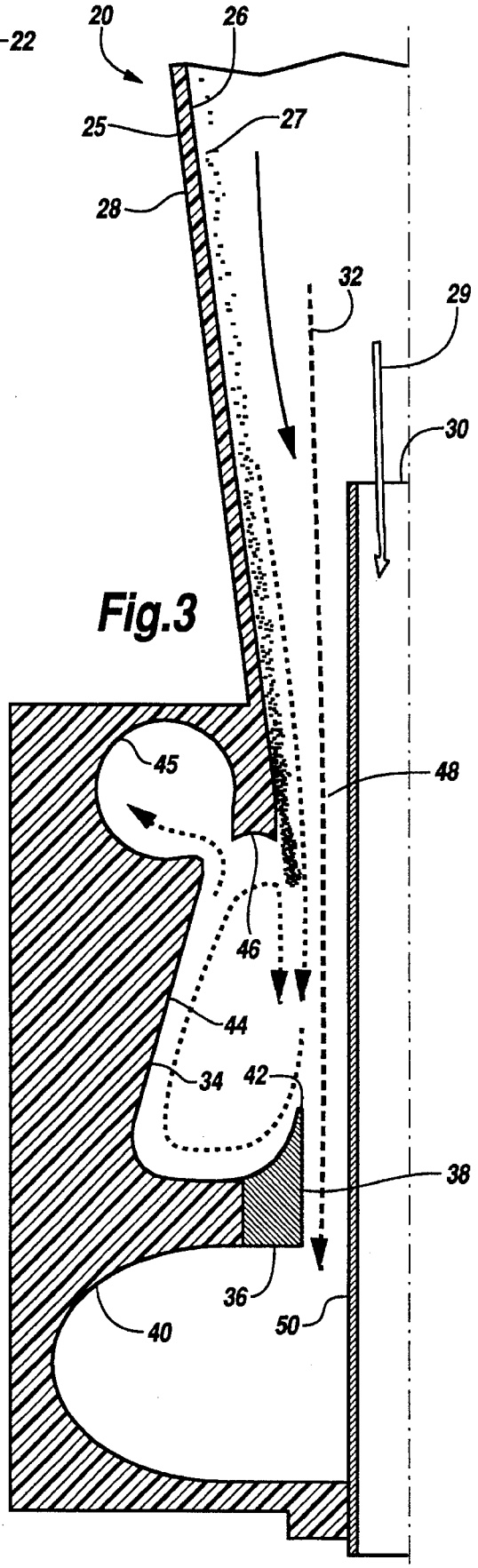
FIG. 3 is a fragmentary schematic view of the fluid and particle flows within the cleaner of FIG. 1.
Figure 2:
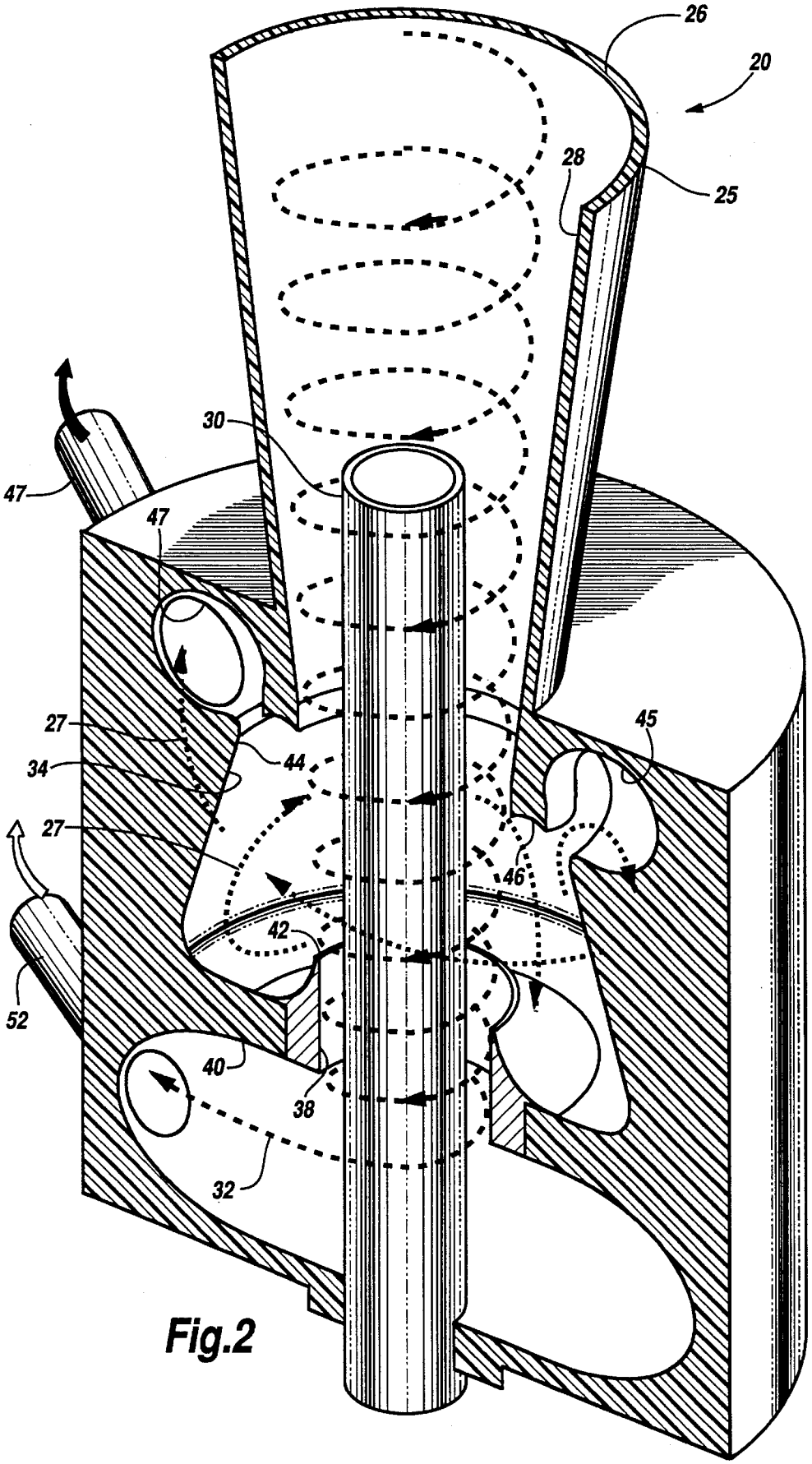
FIG. 2 is an enlarged fragmentary isometric cross-sectional view of the cleaner of FIG. 1 with fluid and particle flows indicated schematically by arrows.

The vortex finder 30 is positioned to remove the light rejects without substantially disrupting the flow of the accepts 32 and the high density particles 27. As shown in FIG. 2, the remaining flow continues to spiral downwardly into an inverted hydrocyclone chamber 34. The inverted hydrocyclone chamber 34 is substantially frustoconical, and hence widens as it extends downwardly. Although the flow is spiraling about the vortex finder 30, as best shown in FIG. 3, the flow has a downward component, with the heavy rejects being radially outward from the accepts. Because of the flows introduced within the inverted hydrocyclone chamber 34, the downwardly flowing stock does not simply expand into the widening inverted hydrocyclone chamber 34. The rotation and axial flow rates of the stock within the inverted hydrocyclone chamber 34 is matched to the rotation and axial flow rates of the stock flowing past the inverted hydrocyclone chamber, reducing the occurrence of turbulence and maintaining the heavyweight contaminants in their location until the flow reaches a lower splitter 36.

The lower splitter 36 is preferably formed from a ceramic such as boron carbide and is press-fit to the cleaner body 25 within the inverted hydrocyclone chamber 34. The splitter 36 has a cylindrical inner wall 38 which defines an annular region 50 with the vortex finder 30 through which accepts flow into the accept chamber 40. The ceramic splitter 36 has an upwardly extending lip 42 which extends into the downwardly flowing stock and which is positioned to split the flow of heavy rejects from the flow of accepts, and to turn the heavy rejects flow radially outwardly and cause it to flow upwardly along the inwardly inclined side wall 44 of the inverted hydrocyclone chamber 34. A portion of the reject flow is drawn out through a heavy rejects torus 45. The flow rate out of the rejects torus through a tangential heavy rejects outlet 47 is controlled by a valve on a heavy rejects take-away header, not shown. The outlet 47 in a preferred embodiment has a diameter of about ¾ inch.

The reject rate for heavyweights does not vary greatly with the back pressure from the rejects outlet because the actual heavyweight outlet is 180 degrees from the primary flow direction, while the rejects and accepts streams are parallel through the region of flow splitting. Because the splitter is precisely positioned to split away the flow of heavy rejects, the width of the annular region 50 may be relatively large to resist plugging. Furthermore, the interface area between the accept stock flowing downwardly around the vortex finder 30 and the heavyweight reject flow which is diverted into the inverted hydrocyclone chamber is large, extending from an upper splitter 46 to the lower splitter 36, and hence the opportunity for plugging of the cleaner 20 is greatly reduced.

The upper splitter 46 is positioned at the juncture between the conical chamber 26 and the inverted hydrocyclone chamber 34. The upper splitter 46 is downwardly concave and causes a portion of the reject flow which is circulating upwardly to be diverted back downwardly parallel to the incoming downward flow from the conical chamber 26. Because the inverted hydrocyclone chamber 34 narrows as it extends upwardly, the velocity of the flow will tend to be increased as it moves upwardly, such that once it is turned by the upper splitter 46, the velocity of the flow between the upper splitter 46 and the lower splitter 36 will be substantially the same as the velocity of the flow of the incoming fluid from the conical chamber 26 in the central region 48 defined radially inwardly of the two splitters 36, 46.

The annular region 50 defined between the lower splitter 36 and the vortex finder 30 has an inner diameter which is less than the inner diameter of the upper splitter 36, as the accepts flow through the annular region 50 will be less than the combined flow of accepts and heavyweight rejects through the central region 48 by the amount of heavyweight reject flow out through the heavyweight reject outlet 47. In other words, the cross-sectional area of the annular region is selected to retain the axial flow velocity of the acceptable particle fluid passing through the annular region approximately equal to the flow velocity of the combined heavyweight particle and acceptable particle flow in the central region 48. Thus the volume flow of acceptable particle flow through the annular region is equal to the volume flow of combined acceptable particle and heavyweight reject flow into the central region 48 less the volume flow of heavyweight reject flow out the heavyweight reject outlet 47.

As best shown in FIG. 3, the flow of heavy rejects within the inverted hydrocyclone chamber 34 may be pictured as a fluid roller bearing, which is matching the flow in the central region 48 both in downward velocity and in rotational speed. This matching of velocities avoids turbulence, and allows the heavy reject flow from the central region to be effectively split off, without mixing, from the accept flow. Furthermore, the fact that only a fraction of the heavy rejects is removed from the inverted hydrocyclone chamber 34 through the heavy rejects torus 45 and heavy rejects outlet 47, allows a greater flow velocity of the heavy rejects component of the stock, as a significant fraction is recirculated.

The acceptable stock 32, from which the heavyweight and lightweight rejects have been removed, passes through the accepts annulus 50 into the accepts chamber 40. Accept flow is drawn off tangentially from the accepts chamber 40 through an accepts outlet 52. The back pressure on the accepts outlet 52 is regulated by a valve on an accepts manifold, not shown, which controls the back pressure for a number of cleaners 20. The desired back pressure may be varied for different types of furnishes and amount of dirt present in the input stock.

Because the accept stock flows from the cleaner to fine screen baskets, effective removal of heavyweight particles can greatly contribute to the wear life of the screen baskets by reducing the quantities of abrasive particles.

Once the cleaner 20 is running, the geometry of the cleaner keeps operational flows generally steady despite minor input flow variations. The convection flows within the cleaner are proportional to the overall tangential velocity, and thus the axial and radial flows increase proportionately.

The cleaner 20, because it removes both heavyweight and lightweight rejects in a single pass, allows the substitution of a single bank of cleaners 20 for a series of first lightweight removing, and then heavyweight removing cleaners. Substitution of a single bank of cleaners for multiple cleaners not only presents reduced equipment costs and space needs, but it reduces the energy requirements for pumping the stock.

Figure 4:
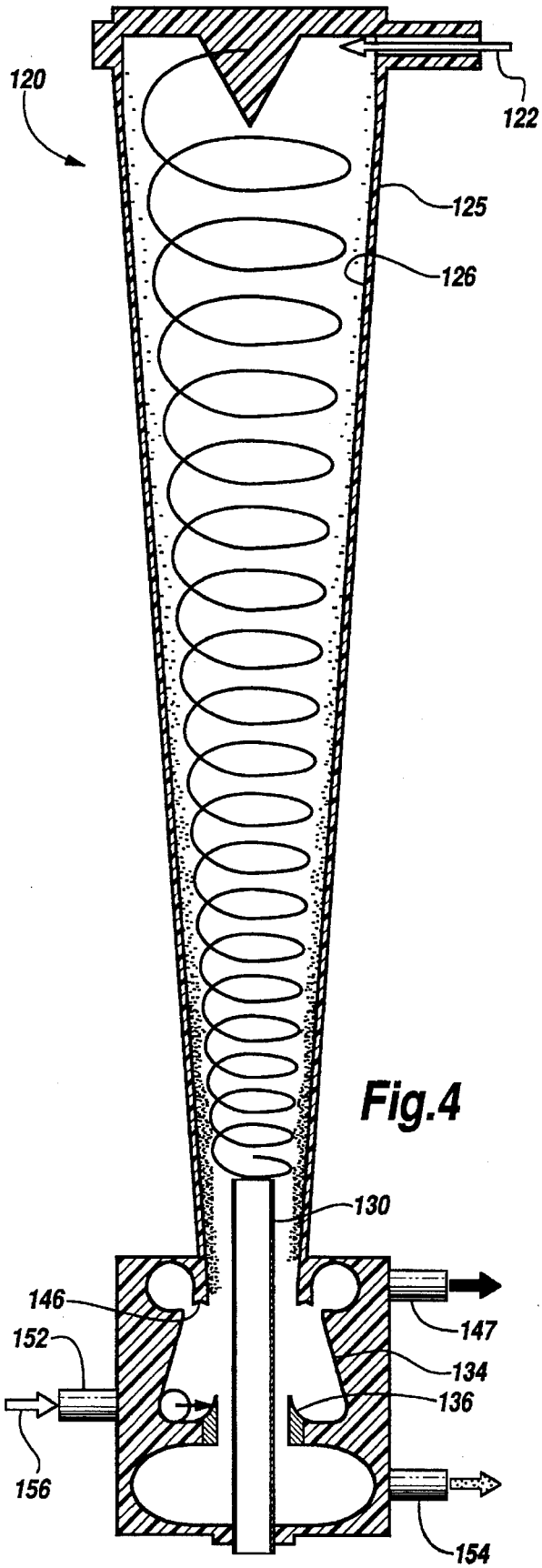
FIG. 4 is a cross-sectional view of an alternative embodiment cleaner of this invention employing white water flows within an inverted hydrocyclone.

An alternative embodiment cleaner 120 is shown in FIG. 4. The cleaner 120 is generally similar in geometry to the cleaner 20, but is larger in scale, and would appropriately be used at the front end of the pulp stock treatment system. The cleaner 120 has a body which defines an inverted conical chamber 126 into which input pulp stock 122 is fed tangentially. The lightweight rejects are removed by a vortex finder 130, and the accepts flow past an upper splitter 146 and a lower splitter 136 to an accepts outlet 154.

The larger openings made possible by the cleaner 120 are less likely to plug up, and a bank of cleaners 120 could be used as a flow splitter for lightweight, heavy, and medium flow components. The cleaner 120 is provided with a white water inlet 154 within the inverted hydrocyclone chamber 134. White water 156 is introduced tangentially through the inlet 154, and thus dilutes the heavyweight rejects circulating within the inverted hydrocyclone chamber 134. This dilution is particularly helpful in higher consistency input stock applications. The dilution reduces clogging in two ways. First, the stock itself is diluted to a lower consistency, and second, because additional fluid is being introduced into the rejects flow, the velocity of the reject flow may be maintained at a higher level, giving less opportunity for heavyweight contaminants to settle out and obstruct any passages as it is drawn out through the heavy rejects outlet 147.

Figure 5:
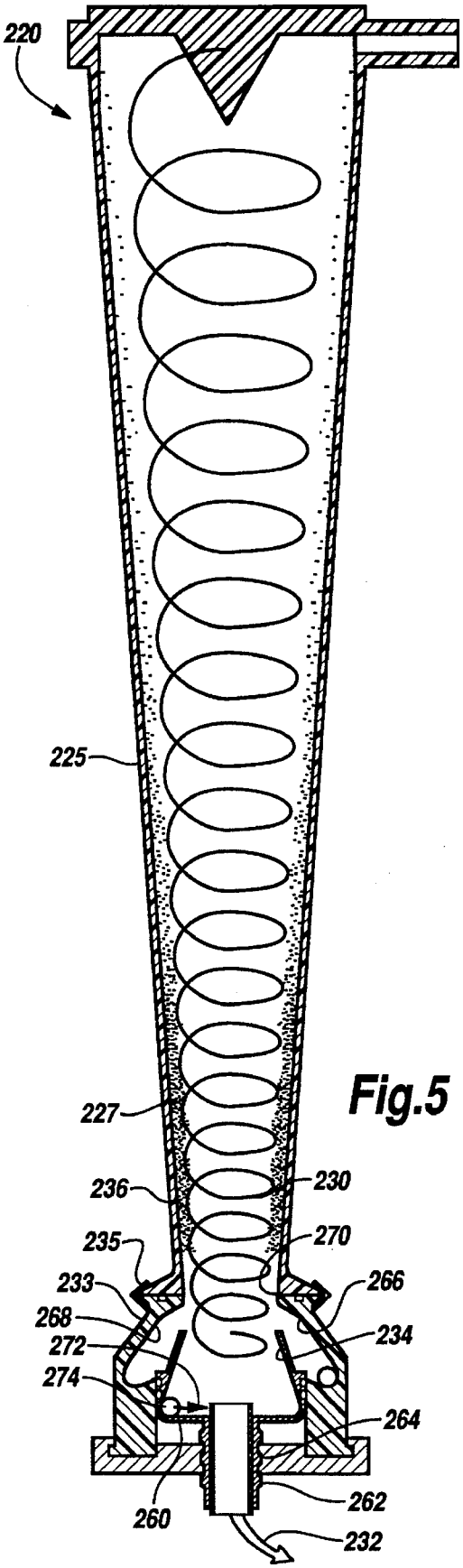
FIG. 5 is a cross-sectional view of another alternative embodiment cleaner of this invention having white water injection within an inverted hydrocyclone.

Another alternative embodiment cleaner 220 is shown in FIG. 5. The cleaner 220 receives input stock 222 through an infeed tube 224 which injects the stock tangentially into an inverted conical chamber 226 defined within the cleaner body 225, which is preferably formed of an upper segment 231 engaged in a quick-release connection with a lower segment 233 by a clamp 235. An O-ring seal is preferably positioned between the two segments 231, 233.

The cleaner 220 is configured to separate heavyweight particles 227 from accepts 232. A vortex finder 230 extends upwardly part way into an inverted hydrocyclone chamber 234 and receives the accepts flow and conducts it out of the cleaner 220. The inverted hydrocyclone chamber 234 is defined within an inverted hydrocyclone element 260 which is preferably formed of a ceramic material, and which has a threaded base 262 which engages with a threaded opening 264 in the cleaner body 225 to allow the adjustment of the elevation of the inverted hydrocyclone element within the body 225.

A heavy rejects chamber 266 is defined between the outer wall 268 of the body lower segment 233 and the inverted hydrocyclone element 260. The rejects chamber 266 thus extends from a neck 270 adjoining the inverted conical chamber 226 to the inverted hydrocyclone element 260. Heavyweight rejects flow is drawn out of the rejects chamber 266 through a rejects outlet 47. White water 272 is introduced into the base of the inverted hydrocyclone chamber 234 through a white water inlet 274. Alternatively the water may be clean water or accepts flow from the secondary stage. Using the pressure of the flow from the hydrocyclone above and the geometry of the rejects chamber, the flow is deflected creating a pinch point in the region of the neck 270. This pinch point region restricts the reject volume from the cleaner, but still allows objects with a large diameter to pass. Thus the reject opening can be large and difficult to clog or block.

The amount of rejects can be controlled by adjusting the height of the inverted hydrocyclone element 260 by rotating the threaded element. This adjustment brings about a change of pressure at the neck 270. The range of pressure in this region or nip should run from above the centrifugal head of the cleaner inverted conical chamber to suction created by the flow leaving the inverted hydrocyclone.

The cleaner 220 allows reject concentration and rate to be controlled and allows a minimum amount of rejects to be drawn from the outside diameter of the hydrocyclone without plugging.

It should be noted that although the cleaners of this invention have been discussed in pulp preparation applications, the cleaners may be used in other positions in the papermaking process.

It is understood that the invention is not limited to the particular construction and arrangement of parts herein illustrated and described, but embraces such modified forms thereof as come within the scope of the following claims.

I claim:

1. A cleaner for separating heavyweight reject particles and light reject particles from acceptable particles in an input fluid flow, the cleaner comprising:

a body having a fluid inlet through which the input fluid flow is injected into the cleaner;

portions of the body defining a first chamber having outer inverted conical walls, wherein the input fluid is injected tangentially into the chamber, and wherein the input fluid is caused to be distributed within the inverted conical chamber such that the heavyweight reject particles are positioned in closer proximity to the walls, the lightweight reject particles are positioned centrally along the axis of the chamber and the acceptable particles are positioned primarily between the heavyweight reject particles and the lightweight reject particles;

a tube which extends axially within the body to receive a portion of the flow containing lightweight reject particles;

portions of the body defining a second chamber having generally frustoconical walls, the diameter of the second chamber narrowing as it extends upwardly, wherein the second chamber is positioned beneath the first chamber;

portions of the body defining a heavyweight reject outlet which extends outwardly from the walls of the second chamber; portions of the body defining an acceptable particle flow outlet positioned below the second chamber and in communication therewith; and a first splitter fixed to the body to extend into the second chamber above the acceptable particle flow outlet, wherein the splitter has a lip which extends into the flow from the first chamber, said lip serving to split a portion of said flow containing heavyweight reject particles into the second chamber, while allowing the remainder of the flow containing acceptable particles to flow to the acceptable particle flow outlet, and wherein a recirculating flow is established within the second chamber of a portion of the flow containing heavyweight reject particles, said recirculating flow extending adjacent the flow downward from the first chamber with low turbulence.

2. The cleaner of claim 1 further comprising a generally toroidal third chamber defined by portions of the body above the second chamber and in communication with the second chamber, wherein the third chamber is coaxial with the second chamber and in communication with the heavyweight reject outlet such that heavyweight rejects pass through the third chamber prior to exiting the cleaner through the heavyweight reject outlet.

3. The cleaner of claim 1 further comprising portions of the body which define an accepts chamber beneath the second chamber, wherein the accepts chamber is in communication with the acceptable particle flow outlet.

4. The cleaner of claim 1 wherein an annular region is defined between the tube and the first splitter, such that flow containing acceptable particles flows through said annular region to the acceptable particle flow outlet.

5. The cleaner of claim 4 wherein the cross-sectional area of the annular region is selected to retain the axial flow velocity of the acceptable particle flow passing through the annular region approximately equal to the flow velocity of the combined heavyweight particle and acceptable particle flow in a central region axially through the second chamber.

6. The cleaner of claim 5 wherein the cross-sectional area of the annular region is selected such that the volume flow of acceptable particle flow through the annular region is equal to the volume flow of combined acceptable particle and heavyweight reject flow into a central region exterior to the tube less the volume flow of heavyweight reject flow out the heavyweight reject outlet.

7. The cleaner of claim 1 further comprising portions of the body which define a second flow splitter positioned within the second chamber and coaxial with the second chamber, said second flow splitter being concave downward and serving to direct the recirculating flow within the second chamber downward.

8. The cleaner of claim 1 further comprising portions of the body which define a water inlet within the second chamber, wherein water is introduced to the second chamber to dilute the heavyweight reject flow therein.

9. The cleaner of claim 1 wherein the first flow splitter is formed of a ceramic material and the body is formed of a plastic material.

10. A cleaner for separating heavyweight reject particles and light reject particles from acceptable particles in an input fluid flow, the cleaner comprising:

a body having a fluid inlet through which the input fluid flow is injected into the cleaner, a heavyweight particle flow outlet, a lightweight particle flow outlet, and an acceptable particle flow outlet;

portions of the body which define a first chamber having outer inverted conical walls, said first chamber narrowing as it extends downwardly, and wherein the input fluid flow is caused to be distributed within the inverted conical chamber such that the heavyweight reject particles are positioned in closer proximity to the walls, the lightweight reject particles are positioned centrally along the axis of the chamber and the acceptable particles are positioned primarily between the heavyweight reject particles and the lightweight reject particles;

a tube which extends axially within the body to receive a portion of the flow containing lightweight reject particles, said tube being in communication with the lightweight particle flow outlet;

portions of the body defining a second chamber beneath the first chamber, wherein the second chamber has frustoconical walls, the diameter of the frustoconical chamber increasing as it extends downwardly;

means for splitting a flow of fluid containing acceptable particles and heavyweight reject particles into separate flows containing either primarily acceptable particles or heavyweight reject particles, said splitting means being positioned adjacent said second chamber;

means for directing at least a portion of said spit flow containing heavyweight reject particles into recirculation within the second chamber, said directing means causing the split heavyweight reject flow portion to have rotational and axial flow rates substantial matched to the rotational and axial flow rates of adjacent unsplit heavyweight reject flows approaching the means for splitting, thereby reducing turbulence therebetween.

11. The cleaner of claim 10 further comprising a generally toroidal third chamber defined by portions of the body above the second chamber and in communication with the second chamber, wherein the third chamber is coaxial with the second chamber and in communication with the heavyweight reject outlet such that heavyweight rejects pass through the third chamber prior to exiting the cleaner through the heavyweight particle flow outlet.

12. The cleaner of claim 10 further comprising portions of the body which define an accepts chamber beneath the second chamber, wherein the accepts chamber is in communication with the acceptable particle flow outlet.

13. The cleaner of claim 10 wherein an annular region is defined between the tube and the means for splitting, such that flow containing acceptable particles flows through said annular region to the acceptable particle flow outlet.

14. The cleaner of claim 13 wherein the cross-sectional area of the annular region is selected to retain the axial flow velocity of the acceptable particle flow passing through the annular region approximately equal to the flow velocity of the combined heavyweight particle and acceptable particle flow in a central region axially through the second chamber.

15. The cleaner of claim 14 wherein the cross-sectional area of the annular region is selected such that the volume flow of acceptable particle flow through the annular region is equal to the volume flow of combined acceptable particle and heavyweight reject flow into a central region exterior to the tube less the volume flow of heavyweight reject flow out the heavyweight particle outlet.

16. The cleaner of claim 10 further comprising portions of the body which defining a means for redirecting flow positioned within the second chamber and coaxial with the second chamber, said means for redirecting flow being concave downward and serving to direct the recirculating flow within the second chamber downward.

17. The cleaner of claim 10 further comprising portions of the body which define a water inlet within the second chamber, wherein water is introduced to the second chamber to dilute the heavyweight reject flow therein.

18. The cleaner of claim 10 wherein the means for splitting is formed of a ceramic material and the body is formed of a plastic material.

19. A cleaner for separating heavyweight reject particles and light reject particles from acceptable particles in an input fluid flow, the cleaner comprising:

a body having a fluid inlet through which the input fluid flow is injected into the cleaner;

portions of the body defining a first chamber having outer inverted conical walls, wherein the input fluid is injected tangentially into the chamber, and wherein the input fluid is caused to be distributed within the inverted conical chamber such that the heavyweight reject particles are positioned in closer proximity to the walls, the lightweight reject particles are positioned centrally along the axis of the chamber and the acceptable particles are positioned primarily between the heavyweight reject particles and the lightweight reject particles;

means for receiving a portion of the flow containing lightweight reject particles;

portions of the body defining a second chamber the diameter of which decreases as it extends upwardly, wherein the second chamber is positioned beneath the first chamber; portions of the body defining a heavyweight reject outlet which extends outwardly from the walls of the second chamber;

portions of the body defining an acceptable particle flow outlet positioned below the second chamber and in communication therewith; and a first splitter fixed to the body to extend into the second chamber to split a portion of the flow containing heavyweight reject particles into the second chamber, while allowing the remainder of the flow containing acceptable particles to flow to the acceptable particle flow outlet, and wherein a recirculating flow is established within the second chamber of a portion of the flow containing heavyweight reject particles, said recirculating flow extending adjacent the flow downward from the first chamber with low turbulence.

20. A cleaner for separating heavyweight reject particles from acceptable particles in an input fluid flow, the cleaner comprising:

a body having a fluid inlet through which the input fluid flow is injected into the cleaner;

portions of the body defining a first chamber having outer inverted conical walls, wherein the input fluid is injected tangentially into the chamber, and wherein the input fluid is caused to be distributed within the inverted conical chamber such that the heavyweight reject particles are positioned in closer proximity to the walls than the acceptable particles;

a tube which extends axially within the body to receive a portion of the flow containing acceptable particles;

portions of the body defining a second chamber positioned beneath the first chamber;

an inverted hydrocyclone element positioned within the second chamber and having walls which extend upwardly, the walls defining a frustoconical surface with a diameter which narrows as the walls extend upwardly, wherein the tube extends upwardly from the inverted hydrocyclone element; a water inlet within the inverted hydrocyclone element, wherein water introduced through said water inlet flows into the second chamber along with heavy reject particles; and portions of the body defining a heavy reject outlet exterior to the inverted hydrocyclone element, through which a heavy reject flow is withdrawn from the cleaner.

21. The cleaner of claim 20 wherein the inverted hydrocyclone element is threadedly engaged with the body such that rotation of said element adjusts the extent to which the inverted hydrocyclone element extends into the second chamber.

* * * * *